United States Patent [19]

Branigan et al.

[11] Patent Number: 4,712,110

[45] Date of Patent: Dec. 8, 1987

[54] FIVE-PORT MONOPULSE ANTENNA FEED STRUCTURE WITH ONE DEDICATED TRANSMIT PORT

[75] Inventors: John T. Branigan, Claremont; David J. Vess, Los Angeles, both of Calif.

[73] Assignee: General Dynamics, Pomona Division, Pomona, Calif.

[21] Appl. No.: 813,365

[22] Filed: Dec. 26, 1985

[51] Int. Cl.[4] ..... H01Q 1/52; H01Q 13/02

[52] U.S. Cl. ..... 343/779; 343/786; 343/840; 343/841

[58] Field of Search ..... 343/786, 776–779, 343/781 R, 782, 783, 840, 841

[56] References Cited

U.S. PATENT DOCUMENTS

| | | | |
|---|---|---|---|
| 2,408,033 | 9/1946 | Beck | 343/786 |
| 2,425,488 | 8/1947 | Peterson et al. | 343/776 |
| 2,455,888 | 12/1948 | Brown | 343/841 |
| 2,677,055 | 4/1954 | Allen | 343/786 |
| 2,925,595 | 2/1960 | Thourel | 343/786 |
| 2,989,747 | 6/1961 | Atchison | 343/779 |
| 2,998,602 | 8/1961 | Cacheris | 343/782 |
| 3,045,238 | 7/1962 | Cheston | 343/786 |
| 3,482,251 | 12/1969 | Bowes | 343/786 |
| 3,495,262 | 2/1970 | Paine | 343/786 |
| 3,500,419 | 3/1970 | Leitner et al. | 343/786 |
| 3,560,976 | 2/1971 | Foldes | 343/786 |
| 3,566,309 | 2/1971 | Ajioka | 343/786 |
| 3,680,142 | 7/1972 | Van Atta et al. | 343/786 |
| 3,701,163 | 10/1972 | Grabowski | 343/786 |
| 4,096,482 | 6/1978 | Walters | 343/776 |
| 4,241,353 | 12/1980 | Salvat et al. | 343/786 |

FOREIGN PATENT DOCUMENTS

| | | | |
|---|---|---|---|
| 122345 | 10/1978 | Japan | 343/786 |

OTHER PUBLICATIONS

Sciambi, "Five Horn Feed Improves Monopulse Performance", *Microwaves*, Jun. 1972, pp. 56–58.

*Primary Examiner*—William L. Sikes
*Assistant Examiner*—Michael C. Wimer
*Attorney, Agent, or Firm*—Neil F. Martin; Edward B. Johnson

[57] ABSTRACT

An antenna feed structure for use with a parabolic reflector in amplitude-comparison monopulse radar applications employs a dedicated transmit feed centered within a four-port receive array of conventional element spacing to eliminate the need for a circulator or other transmit/receive device while retaining satisfactory receive array performance. Isolation pins placed around the transmit port act to decouple it from the receive ports, and a double waveguide run to the transmit port reduces uneven heating and related phase imbalance in adjacent receive waveguide runs.

13 Claims, 10 Drawing Figures

FIVE-PORT MONOPULSE ANTENNA FEED STRUCTURE WITH ONE DEDICATED TRANSMIT PORT

BACKGROUND OF THE INVENTION

This invention relates generally to radar antenna systems and particularly to a five-port monopulse feed structure.

Using electromagnetic energy for the detection and location of objects, radar systems employ the well known method of transmitting a signal in a direction of interest and analyzing any echos. Objects in the path of energy emanating from the radar antenna redirect energy back to the antenna where it is processed at four receive ports through a comparator to determine positional information.

Many radar applications employ a special type of radar system called an amplitude-comparison monopulse system. Able to achieve the high precision required in such applications as weapon control and missile-range instrumentation, the monopulse system transmits a single pulse of energy in a very narrow beam toward a target and then analyzes the pattern of reflected energy according to its placement about the beam axis. When the reflected energy returns in a pattern symmetrically disposed about the beam axis, the beam is pointed right at the target. When the pattern is off center, the beam is pointed correspondingly off target.

The manner in which the pattern of reflected energy is disposed about the beam axis is deduced using four separate receiving structures called waveguide horns. These four receive horns define four openings, or ports, placed symmetrically about the feed point of a parabolic reflector. This four-port receive array is interconnected to the rest of the monopulse system by suitable waveguide components that define a path for electromagnetic waves to follow from the antenna to other components in the system.

Reflected energy returning to the antenna excites each of the four horns according to how the pattern of reflected energy is disposed about the beam axis. This energy then propagates along the waveguide components to signal processing components that precisely calculate target position by comparing the relative amplitudes of the energy received by each of the horns.

To visualize this, imagine four water glasses grouped tightly together under a water faucet. Water from the faucet fills the glasses at the same rate when the glasses are grouped symmetrically about the central axis of the flow of water. This is analogous to a monopulse radar beam being right on target with the four horns grouped symmetrically about the central axis of the reflected energy.

But just as the water glasses fill at different rates if the flow of water is off center, so does the energy received by each of the four horns vary when the target, and therefore the reflected energy, is off center. By carefully analyzing the relative amplitudes of reflected energy received through each of the four horns, the amount the target is off center can be precisely determined.

The horns are carefully positioned to do this. They are positioned at just the right spacing relative to each other and relative to the focal point of the parabolic reflector, and this enables accurate analysis of a narrow beam of reflected energy to determine placement about the beam axis. In this manner, a conventional amplitude-comparison monopulse radar system uses a four-horn array in conjunction with a parabolic reflector to achieve precise weapon control and missile-range instrumentation. This invention improves upon the four-horn array.

In existing amplitude-comparison monopulse radar systems, electromagnetic energy (RF) of a frequency suitable for radar applications is transmitted through the same four horns that are used to receive the reflected energy. What is called a circulator, or functionally equivalent transmit/receive (TR) device, properly routes the signal to enable the four horns to serve this dual purpose. Thus, a single RF pulse is generated and routed via the TR device to the four horns where it is transmitted toward a target, reflected back to the horns, and then routed once again via the TR device to signal processing components.

Although this arrangement manages to employ the four horns in both the transmit and receive mode, it has certain drawbacks related to the TR device. These include the added cost, size, and volume of a circulator or other TR device, as well as the power limitations and the complex waveguide plumbing required.

And while some designs employ a separate feed for transmitting energy, they upset critical spacing of the four receive horns and result in a feed structure unsuited for precise monopulse work with a parabolic reflector.

Consequently, it is desirable to have a new feed structure for amplitude-comparison monopulse radar applications that alleviates these concerns—one that eliminates the need for a circulator or other TR device, retains essential features and placement of the four-horn array, and adapts to use with a conventional parabolic or other concave reflective surface.

SUMMARY OF THE INVENTION

This invention recognizes the problems associated with existing designs and provides an improved five-port antenna feed structure with the desired attributes.

A feed structure constructed according to the invention employs a transmit feed structure that defines a single transmit port at the feed point of a parabolic or other concave reflector, and a receive structure that defines four receive ports arranged about the transmit port in a four-port array suitable for amplitude-comparison monopulse radar applications.

Means are included for decoupling the receive ports from the transmit port, and one embodiment includes a double waveguide run to the transmit port that reduces uneven heating and related phase imbalance in adjacent receive waveguide runs.

Thus, the essential attributes of a conventional four-horn array are retained while the need for a circulator is eliminated.

The above and other objects and advantages of the invention will become more fully apparent upon reading the detailed description in conjunction with the drawings.

DETAILED DESCRIPTION

Figure 1:
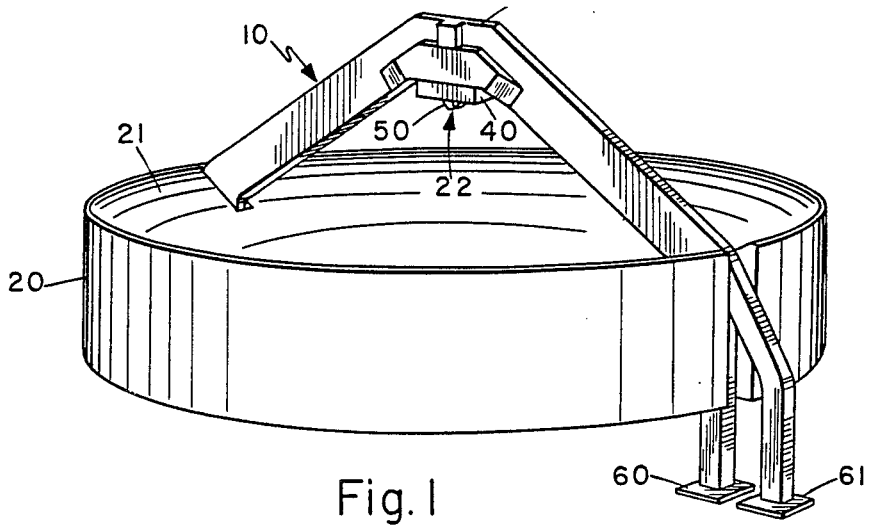
FIG. 1 of the drawings is a perspective view of a five-port monopulse antenna feed structure constructed in accordance with the invention.

A five-port monopulse antenna feed structure constructed in accordance with the invention is illustrated in FIG. 1 where it is referred to generally by reference numeral 10. It includes reflector 20 which defines reflective surface 21 with associated focal point 22.

Transmit feed structure 30 and four-port receive structure 40 are aligned relative to focal point 22 to operate in combination with reflector 20 as a monopulse radar antenna, and isolation loops 50 are visible in the position they occupy in decoupling the four-port receive structure of this invention form the transmit feed structure.

These are the major components of the illustrated feed structure, interconnectable with the rest of the radar system by couplings 60 and 61. Reflective surface 21 is generally parabolic, and it is shaped and dimensioned according to known design techniques to provide a reflective surface for RF of the frequency employed in the radar system. It directs energy emanating from transmit feed structure 30 into a narrow beam about a beam axis pointed toward a direction of interest, and it focuses reflected energy returning along the beam axis back to four-port receive structure 40.

Transmit feed structure 30 and four-port receive structure 40 cooperate with reflector 20 in doing this. They employ known waveguide design techniques to define a path along which electromagnetic energy will propagate to and from the reflector. They differ from existing designs, however, in several important aspects. Most notably, the four-port receive array comprises a standard four-port monopulse feed that has been modified to include a fifth waveguide port used as a dedicated transmit horn. This fifth port occupies a position centered between the four receive ports so that it shares the same central axis as the four receive ports. The spacing of the four receive ports is left unchanged in doing this in order to retain satisfactory performance of the receive structure, the fifth port being centered between them in a position physically replacing the inner corner of each of the four receive ports.

Figure 2:
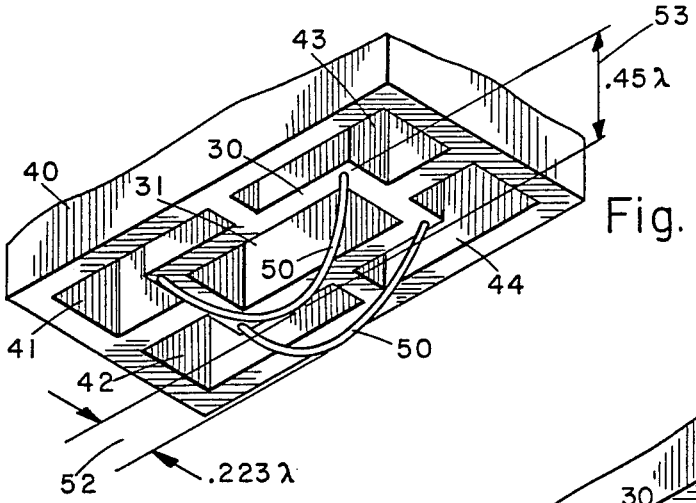
FIG. 2 is an enlarged perspective view of the five port arrangement.
Figure 3:
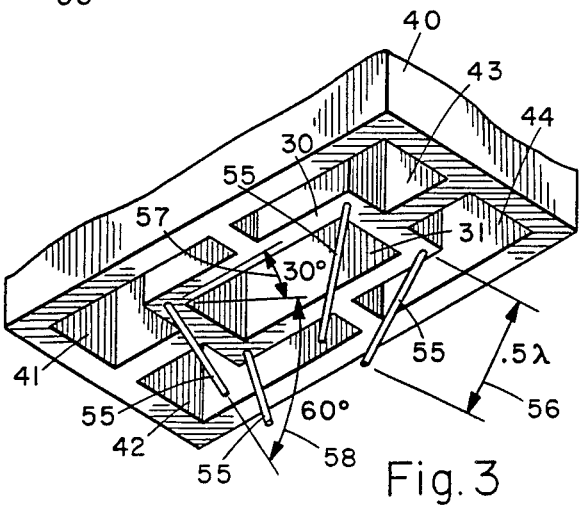
FIG. 3 is a similar view showing an alternative arrangement employing isolation pins.

Details of this structure are shown in FIGS. 2 and 3 where four-port receive structure 40 defines four receive ports, receive ports 41–44. These receive ports are aligned relative to each other and relative to focal point 22 in the manner of a conventional four-port monopulse antenna system. However, transmit feed structure 30 defines an additional fifth port, transmit port 31, centered within the four-port array.

Thus, a two plane monopulse antenna system with both transmit and receive capability is achieved by utilizing an additional radiating port for the transmit mode apart from the four ports used for the receive mode. This five-port system used in conjunction with a parabolic reflector eliminates the need for a transmit/-receive (TR) isolating device, such as a circulator. The parabolic reflector antenna system transmits and receives energy from the same antenna focal point, but through different ports. More power can be transmitted while less cost, volume, and waveguide plumbing is involved, and the design concept can be adapted to most any active monopulse antenna system which utilizes a parabolic reflector.

Figure 4:
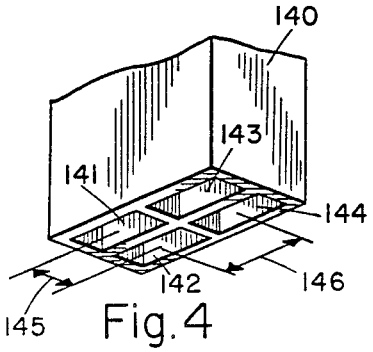
Fig. 4 PRIOR ART
FIG. 4 is a perspective view of a typical four-port feed of the prior art.

In the design of any monopulse feed system used in conjunction with a parabolic reflector, such as prior art structure 140 defining receive ports 141–144 in FIG. 4, it is necessary to maintain a given element spacing (arrows 145 and 146) between the four receive ports so that the sum and delta beams will form properly. If the elements are separated due to the insertion of a fifth centrally located port, the beam will become too wide. This invention utilizes the technique described above to provide a transmit radiating aperture that physically replaces the inner corner of each of the four receive ports. With this technique, element spacing is kept intact.

However, with this technique, unwanted coupling to the receive array is introduced, coupling that degrades sum port radiation patterns. Isolation loops 50 in FIG. 2 (and isolation pins 55 shown as alternatives in FIG. 3) serve as means to decouple the receive ports from the transmit port and retain satisfactory performance of the receive ports.

Isolation loops 50 are spaced approximately 0.45 wavelength where they are joined to the transmit feed structure as indicated by dimension 53 in FIG. 2, and this spacing narrows to approximately 0.223 wavelength as indicated by dimension 52 in FIG. 2. Isolation pins 55 are approximately 0.5 wavelength in length as indicated by dimension 56 in FIG. 3, and they are connected about transmit port 31 at the approximate angles indicated by arrows 57 and 58 in FIG. 3.

The isolation pins or loops (isolators) are electrically conductive at the RF frequency employed, and they are attached to the transmit feed in the positions shown by suitable means such as bonding or press fitting. RF energy impinging on the isolators from the transmit port is coupled out of phase to the four receive ports so that it cancels the normally coupled RF signal. The isolators are designed for optimized performance with attention to overall radiation characteristics of both the transmit and receive modes since maximum isolation may not necessarily provide best overall antenna performance. Other means of isolating the receive ports from the transmit port may be employed and a cut-and-try approach used to derive precise size and placement of the isolators and to optimize performance in balancing isolation with the effect on overall radiation characteristics.

Figure 5:
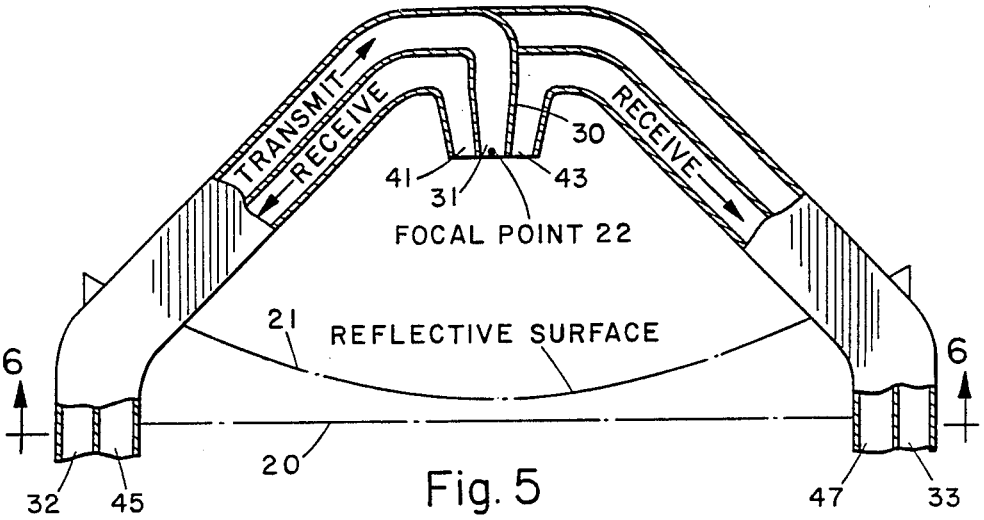
FIG. 5 is a side elevation view, partially cut away, of the waveguide and port assembly.
Figure 6:
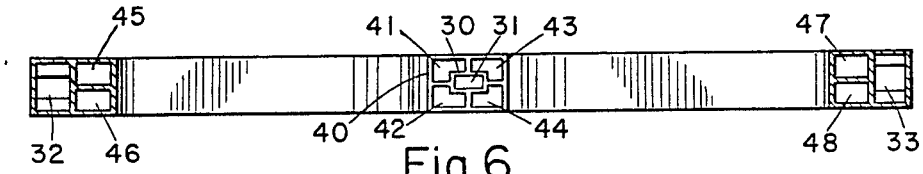
FIG. 6 is a sectional view taken on line 6—6 of FIG. 5.

Additional details of transmit feed structure 30 and receive structure 40 are shown in FIGS. 5 and 6. Structures 30 and 40 are mechanically mounted by suitable means (not illustrated) so that they retain alignment with reflector 20 (transmit port 31 aligned as shown with focal point 22). RF energy generated by suitable known components (not illustrated) propagated along transmit waveguide run 32 to transmit port 31, reflected RF energy received by receive ports 41–44 then propagates along receive waveguide runs 45–48 to signal processing components (not illustrated), and dummy waveguide run 33 maintains structural symmetry although it does not propagate energy.

Since the waveguide run that delivers power to the transmit horn of the five-port feed will rise in temperature due to waveguide attentuation of the high power, the generated heat will conduct into adjacent receive waveguides. Thus, heating of transmit waveguide run 32 will cause heating of receive waveguide runs 45 and 46 (FIGS. 5 and 6). This heating of the receive waveguides will cause an expansion of the waveguide material, and hence, a phase change of the RF energy in two of the waveguide runs. Consequently, two of the four receive waveguide runs will experience this phase shift, and therefore, an unbalance in the phase of the received signals. The overall effect of this asymmetrical waveguide expansion will appear as insufficient null depths in the H plane delta patterns.

Figure 7:
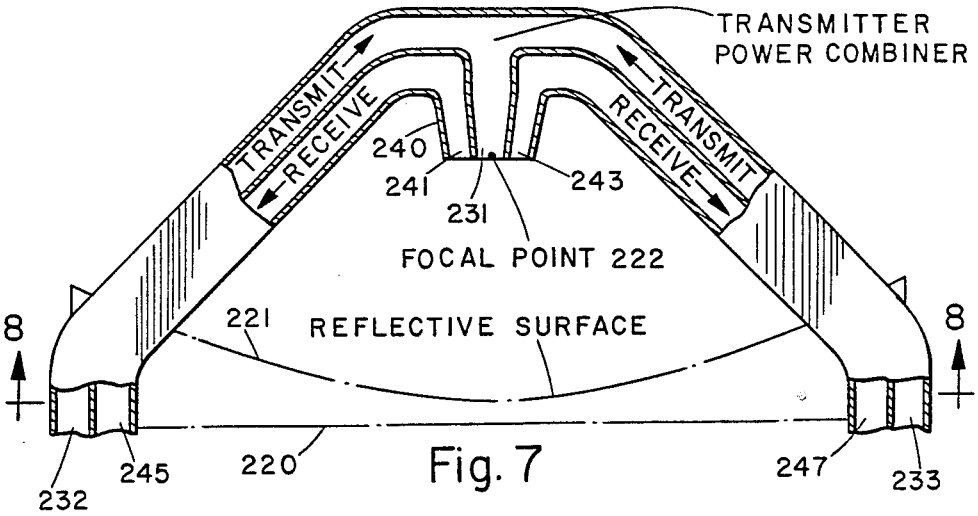
FIG. 7 is a side elevation view, partially cut away, of an alternative waveguide and port assembly.
Figure 8:
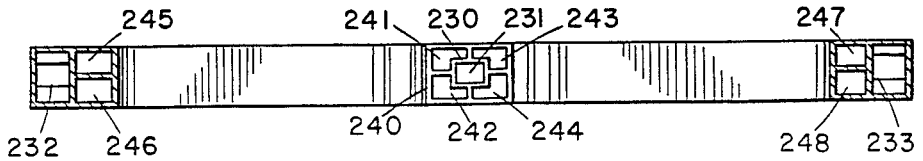
FIG. 8 is a sectional view taken on line 8—8 of FIG. 7.

A solution to overcome uneven heating of the receive waveguides (in lieu of including phase adjustment means along the waveguide runs) is illustrated in the alternate design of FIGS. 7 and 8. This design includes transmit feed structure 230 defining transmit port 231 and transmit waveguide runs 232 and 233, in combination with four-port receive structure 240 defining receive ports 241–244 and receive waveguide runs 245–248. In this configuration, transmit power is divided, by components not illustrated, and routed up two different paths defined by transmit waveguide runs 232 and 233. The power is combined at the top of the feed and transmitted out through the single transmit port. In this case, heating of the receive waveguide runs is uniform and phase imbalance does not occur.

Figure 9:
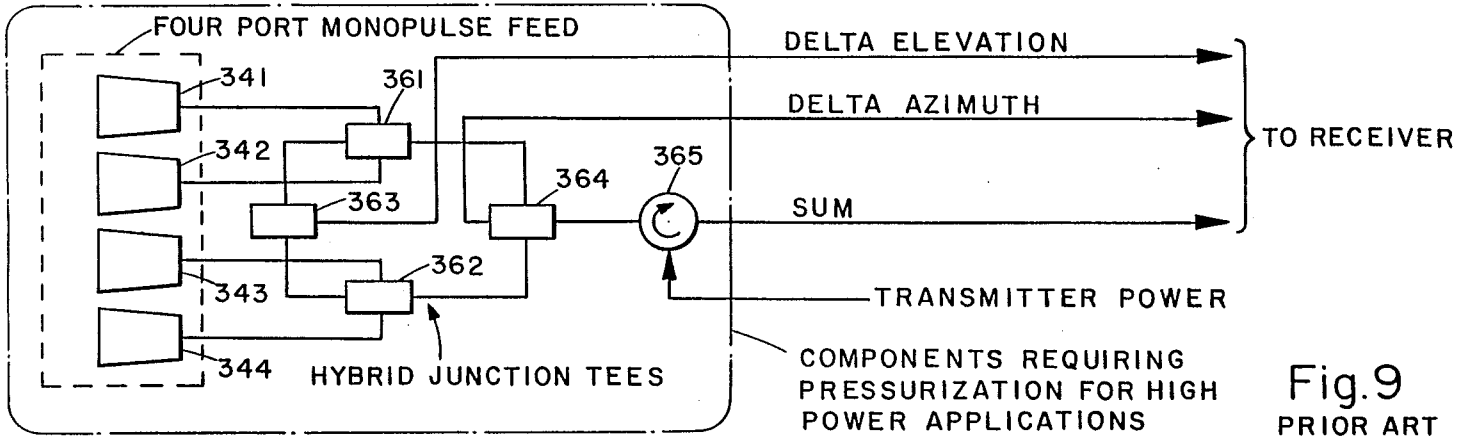
Fig. 9 PRIOR ART
FIG. 9 is a schematic of the prior art four-port antenna feed system.

FIG. 9 shows a portion of a schematic for a typical four-port monopulse antenna system. This system includes four radiating apertures, horns 341–344, a comparator network made up of hybrid junction tees 361–364, and circulator 365 to permit transmit capability. Operation of this system requires transmit power to be supplied through the circulator which subsequently directs the transmitted RF energy toward the comparator while isolating the receiver. The power is then divided four ways in the comparator and radiated out of the four ports of the monopulse feed.

Return power from the illuminated target is then received by the same four ports and directed through the comparator toward the receiver, the circulator allowing receiver power to pass to the receiver while providing isolation between the sum channel of the receive port and the transmitter.

Figure 10:
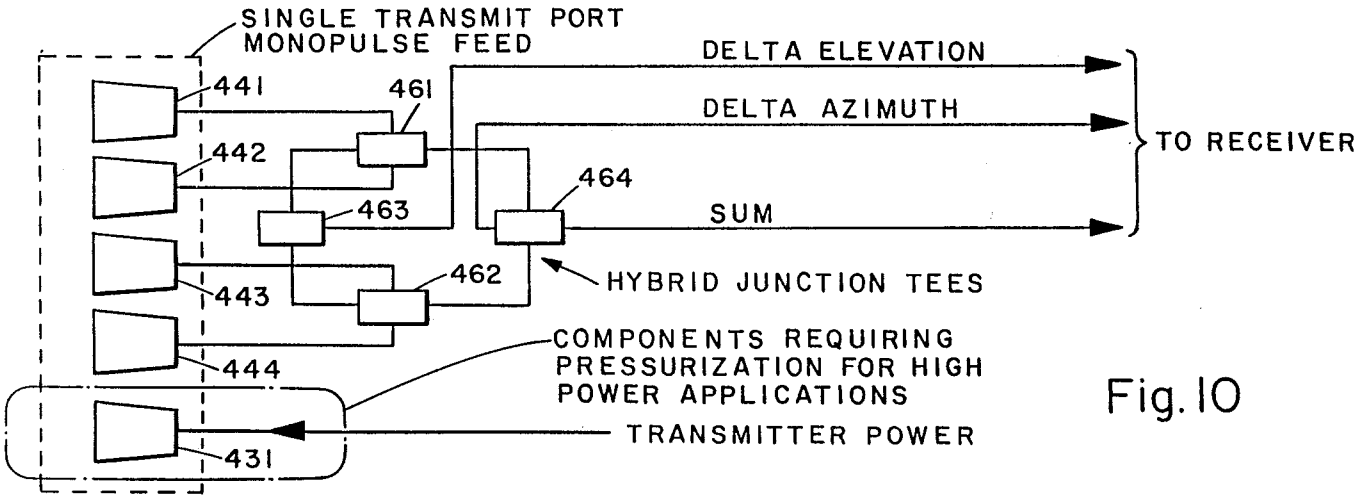
FIG. 10 is a schematic of the antenna feed structure of the present invention.

In comparison, FIG. 10 shows a functionally similar schematic but with the introduction of the single port transmit feed, horn 431, in conjunction with the four-port monopulse receive array, horns 441–444. Transmit power is supplied directly to the feed opening through a single dedicated feed port in this antenna system. The receive function of the system is the same as to that of the four-port monopulse system in FIG. 9, except that the sum channel energy derived from hybrid junction tees 461–464 is directed directly toward the receiver without passing through a circulator. Thus, the requirement for a circulator to provide the needed transmit/-receive isolation is eliminated.

The effect on radiation patterns in both E and H planes of this design is to increase the sum beamwidth slightly. While this increase is undesirable, it is offset by a beam narrowing occuring in the transmit mode that is caused by transmission through a single port aligned on the antenna axis instead of through four ports arranged around the axis in a conventional four-port monopulse configuration. A four-port transmit feed radiates energy out of the four separate ports, each of which produces a beam canted to a specific angle. The summation of these four beams produces a wider beam than the beam produced by this invention which radiates out of a single central port to produce a narrower beam, and consequently, a slightly higher gain. The increased gain due to the narrower transmit beamwidth offsets the reduced gain due to the increased received beamwidth so that the overall system performance is as good or better with the single transmit port as compared to a conventional four-port monopulse feed with a circulator.

The use of the single transmit port feed eliminates the requirement of a high power circulator mounted on the gimballed seeker head platform for antenna systems with wide angle gimbal requirements. High power circulators are inherently massive and bulky such that the exclusion of this device along with its counter weight will significantly reduce the overall seeker head weight. Cost benefits are also derived by the exclusion of the circulator from the antenna system. In addition, pressurization of the transmit waveguide to prevent arcing is simplified. The waveguide run feeding the single transmit horn is all that would require pressurization, instead of having to pressurize the receive comparator as in the prior art four-port design.

Since various changes may be made in the form, construction, and arrangement of the procedures and parts described without departing from the spirit and scope of the invention and without sacrificing any of its advantages, the foregoing description should be interpreted as illustrative and not in any limiting sense.

What is claimed is:

1. An antenna feed structure, which comprises:

a single transmit horn for transmitting signals to a reflective surface;

an array of four receive horns arranged symmetrically about the transmit horn for receiving energy directed from the reflective surface;

feed means for feeding power to be transmitted to the central transmit horn only;

collecting means for collecting power received at the four receive horns only; and decoupling means for decoupling the receive horns from the transmit horn, the decoupling means comprising phase-shift means for inducing a phase shift in energy emanating from the transmit horn toward the receive horns, the phase shift means including a plurality of isolation pins attached about the periphery of the transmit horn and inclined towards one another.

2. The structure recited in claim 1, wherein the transmit horn has a rectangular outer periphery and the isolation pins are curved loops having ends attached to the four corners of the transmit horn.

3. The structure recited in claim 1 wherein the transmit horn has a center located at the center of the four horn receive array.

4. The structure recited in claim 3, wherein the receive horns are arranged in a square array having common dividing walls separating adjacent horns, each receive horn having a cut-out area at its innermost corner, the cut-out areas of the four horns defining a central area of equivalent shape to the receive horns, and the transmit horn is positioned in the central cut-out area of the receive horn array.

5. The structure recited in claim 1 which includes heat-reducing means for reducing uneven heating and related phase imbalance in the receive array.

6. The structure recited in claim 1, wherein the feed means includes a dual transmit waveguide run connected to the central transmit horn and the collecting means comprises four receive waveguides, each receive waveguide comprising means for connecting a respective one of the four receive horns to signal receiving means, two of the receive waveguides running adjacent one of the transmit waveguide runs and the other two receive waveguides running adjacent the other transmit waveguide run.

7. A five port antenna and feed structure suitable for use in an amplitude-comparison monopulse system, which comprises:

a reflective surface having an associated focal point;

four receive horns arranged in a square array centered at the focal point, each horn having a cut-away area adjacent the center of the array, with the four cut-away areas being shaped and dimensioned to provide a central opening between the four receive horns of shape corresponding to that of each receive horn;

a transmit horn positioned in the central opening between the four receive horns;

feed means for directing power to be transmitted to the central transmit horn only;

collecting means for collecting power received at the four receive horns only; and means for decoupling the receive horns from the transmit horn, including a plurality of isolation pins attached about the periphery of the transmit horn to phase shift a portion of energy transmitted from the transmit horn to the receive horns.

8. The structure recited in claim 7 which includes heat-compensating means for reducing phase imbalance in the receive array caused by heat that is transferred from the transmit feed.

9. The structure recited in claim 8 wherein the heat-compensating means includes a dual transmit waveguide run.

10. The structure recited in claim 7, wherein the four receive horns are of identical rectangular cross-section and have common dividing walls separating them from each adjacent receive horn, and the central opening for receiving the transmit horn comprises a generally rectangular cut-out of the innermost four corners of the receive horns.

11. The structure recited in claim 7, wherein the isolation pins comprise a pair of spaced curved loops each having their opposite ends attached to spaced points around the periphery of the center horn, the looped portions of the pins being inclined towards one another.

12. The structure recited in claim 11, wherein the maximum spacing between the loops where they are joined to the horn is approximately 0.45 times the wavelength of the transmitted radiation and the minimum spacing between the loops is approximately 0.223 times the wavelength.

13. The structure recited in claim 7, wherein the isolation pins are straight pins spaced around the periphery of the center horn and are inclined inwardly at their free ends towards the center of the horn at an angle of approximately 60 degrees, the pins being of length approximately 0.5 times the wavelength of the transmitted radiation.

* * * * *